US012344999B2

(12) United States Patent
Needham

(10) Patent No.: US 12,344,999 B2
(45) **Date of Patent: *Jul. 1, 2025**

(54) PARKING LOT SYSTEMS

(71) Applicant: Everyman Investments, LLC, Dallas, TX (US)

(72) Inventor: Steven Anthony Needham, Dallas, TX (US)

(73) Assignee: EVERYMAN INVESTMENTS, LLC, Dallas, TX (US)

( * ) Notice: Subject to any disclaimer, the term of this patent is extended or adjusted under 35 U.S.C. 154(b) by 635 days.

This patent is subject to a terminal disclaimer.

(21) Appl. No.: 17/701,584

(22) Filed: Mar. 22, 2022

(65) Prior Publication Data

US 2022/0213654 A1 Jul. 7, 2022

Related U.S. Application Data

(63) Continuation-in-part of application No. 17/314,019, filed on May 6, 2021, now Pat. No. 11,299,900.

(60) Provisional application No. 63/025,818, filed on May 15, 2020.

(51) Int. Cl.
*E01C 1/00* (2006.01)

(52) U.S. Cl.
CPC ..... *E01C 1/002* (2013.01)

(58) Field of Classification Search
CPC ..... E01C 1/002
See application file for complete search history.

(56) References Cited

U.S. PATENT DOCUMENTS

| | | | |
|---|---|---|---|
| 1,682,679 | A | 8/1928 | Lawton |
| 2,659,109 | A | 11/1953 | Burn et al. |
| 2,815,540 | A | 12/1957 | George |
| 3,641,727 | A | 2/1972 | Hill |
| 3,739,540 | A | 6/1973 | Ennis |

(Continued)

FOREIGN PATENT DOCUMENTS

CN 209482799 U 10/2019

OTHER PUBLICATIONS

International Search Report and Written Opinion received in Patent Cooperation Treaty Application No. PCT/US2021/032109, dated Aug. 13, 2021, 16 pages.

(Continued)

*Primary Examiner* — Abigail A Risic
(74) *Attorney, Agent, or Firm* — Johnston IP Law, PLLC

(57) ABSTRACT

In one instance, a parking lot system is presented with a first driveway in a first direction and a second driveway in a second direction opposite the first direction. The first driveway includes a first plurality of parking spaces, wherein each parking space comprises a first rectangular space to accommodate an automobile. A second rectangle is adjacent to the first rectangular space. The second driveway includes a second plurality of parking spaces, wherein each parking space comprises a third rectangular space sized to accommodate an automobile. The second rectangle is adjacent to the third rectangle. The second rectangle forms a buffer zone into which automobile doors in the second and third rectangle may open. The first and second plurality of parking spaces at least partially abut one another directly. Other systems are also presented.

15 Claims, 6 Drawing Sheets

(56) References Cited

U.S. PATENT DOCUMENTS

| | | | | |
|---|---|---|---|---|
| 4,264,923 | A | 4/1981 | Reich | |
| 5,279,085 | A * | 1/1994 | DiPaolo | E04H 3/04 52/33 |
| 5,718,551 | A | 2/1998 | Ebstein | |
| 7,784,228 | B2 | 8/2010 | Gustafson | |
| 10,041,264 | B2 | 8/2018 | Olsen | |
| 2005/0235587 | A1 | 10/2005 | Blumberg et al. | |
| 2008/0038054 | A1 | 2/2008 | Gustafson et al. | |
| 2013/0152493 | A1 * | 6/2013 | Karisch | E04H 6/426 52/174 |
| 2014/0072178 | A1 | 3/2014 | Carbonell et al. | |
| 2017/0212511 | A1 | 7/2017 | Ferreira et al. | |

OTHER PUBLICATIONS

Loomis Municipal Code, Title 13 Zoning, Division 3 Site Planning and General Development Regulations, Chapter 13.36—Parking and Loading, 13.36.090—Parking design and development standards. https://qccode.us/codes/loomis/view.php?topic=13-3-13_36-13-_36_090&frames=on.

Thesis-International Cruise Terminal in Goa, by Sanah Patel, Architect, Jul. 1, section 7.14; https://www.slideshare.net/sanahpatel1/thesis-international-cruise-terminal-in-goa.

* cited by examiner

PARKING LOT SYSTEMS

RELATED APPLICATION

This application is a continuation-in-part application of U.S. patent application Ser. No. 17/314,019, filed, May 6, 2021, and entitled, "Parking Lot Systems," which claims the benefit of U.S. Provisional Patent Application No. 63/025,818, filed on May 15, 2020, and entitled, "Parking Lot Systems." Both applications are incorporated herein by reference for all purposes.

TECHNICAL FIELD

This application is directed, in general, to parking cars, and more specifically, to parking lot systems.

BACKGROUND

Parking lots tend to require a lot a valuable real estate in order to accommodate an appropriate number of parking spaces. In some jurisdictions, a minimum number of parking spaces must be provided depending on the size of the building corresponding to the parking lot. Meanwhile, the lack of space for opening automobile doors may cause damage to automobiles and make it more difficult for people to enter and exit their automobiles.

A common parking lot arrangement positions parking spaces, or stalls, perpendicular to the driveway. This type of arrangement either takes up a lot of real estate or the parking spaces tend to be so small that it is difficult to open automobile doors without hitting automobiles parked in adjacent spaces.

SUMMARY

According to an illustrative embodiment, a parking lot system includes a first one-way driveway in a first direction and a second one-way driveway in a second direction that is opposite to the first direction. The second one-way driveway is adjacent to the first one-way driveway. The first driveway comprising a first plurality of parking spaces on one side, wherein each parking space of the first plurality of parking spaces comprises a first rectangular space sized to accommodate an automobile and having a second rectangle adjacent to the first rectangle. The second rectangle comprises a buffer zone into which a door of an automobile in the first rectangle may open. The second driveway comprising a second plurality of parking spaces on one side closest to the first driveway. Each parking space of the second plurality of parking spaces comprises a third rectangular space sized to accommodate an automobile. The second rectangle is adjacent to the third rectangle and comprises the buffer zone into which a door of an automobile in the third rectangle may open. The first plurality of parking spaces and the second plurality of space at least partially abut one another directly.

According to another illustrative embodiment, a parking lot system includes a first driveway extending in a first one-way direction of travel, the first driveway comprising a first plurality of angled parking spaces positioned on one side of the first driveway. Each parking space of the first plurality of angled parking spaces forms a first rectangular space sized to accommodate an automobile, the first rectangular space at least partially defined by a first side, a second side and a third side, wherein the first and second sides are parallel. The parking lot system further includes a second driveway extending in a second one-way direction of travel that is opposite to the first one-way direction, the second driveway comprises a second plurality of angled parking spaces positioned on a side of the second driveway closest to the first driveway, wherein each parking space of the second plurality of angled parking spaces forms a second rectangular space sized to accommodate an automobile. The second rectangular space is at least partially defined by a first side, a second side and a third side, wherein the first and second sides of the second rectangular space are parallel. The parking lot system further includes a plurality of buffer zones, wherein a perimeter of each of the plurality of buffer zones is formed by a portion of the first and second plurality of angled parking spaces such that the each of the plurality of buffer zones is surrounded on all sides by the first and second plurality of angled parking spaces. The first plurality of parking spaces and the second plurality of parking spaces at least partially abut one another directly.

According to yet another illustrative embodiment, a parking lot system includes a first one-way driveway in a first direction and a second one-way driveway in a second direction that is opposite to the first direction. The first driveway has a first plurality of angled parking spaces on one side, wherein each parking space of the first plurality of angled parking spaces comprises a first rectangular space sized to accommodate an automobile. The second one-way driveway is adjacent to the first one-way driveway and has a second plurality of angled parking spaces on one side closest to the first driveway, wherein each parking space of the second plurality of angled parking spaces comprises a second rectangular space sized to accommodate an automobile. The parking lot system further includes a buffer zone positioned between the first plurality of angled parking spaces and the second plurality of angled parking spaces. The buffer zone comprises a gap in a zig-zag pattern that extends along a length of the first and second plurality of angled parking spaces. The gap is sized to form a pedestrian walkway between the first plurality of angled parking spaces and the second plurality of angled parking spaces. The gap is further sized for receiving a door from an automobile positioned in any of the first and second plurality of angled parking spaces.

According to another illustrative embodiment, a parking lot system includes a plurality of one-way driveways with adjacent driveways going in opposite directions. For each one-way driveway, the system includes a plurality of first parking spaces and a second plurality of parking spaces. Each parking space of the first plurality of parking spaces and the second plurality of parking spaces has a longitudinal length of between 130% to 140% of an average car length. Each parking space of the first plurality of parking spaces and the second plurality of parking spaces is angled with respect to a direction of the one-way driveway between 25 and 35 degrees. Other systems and methods are disclosed.

DESCRIPTION OF THE DRAWINGS

Illustrative embodiments of the present disclosure are described in detail below with reference to the attached drawing figures, which are incorporated by reference herein and wherein.

DETAILED DESCRIPTION

Real estate for parking lots can be expensive. Parking lot arrangements and systems that efficiently use space, while helping to avoid interference when opening automobile doors and avoiding door dings between adjacent automobiles may be beneficial.

Figure 1:
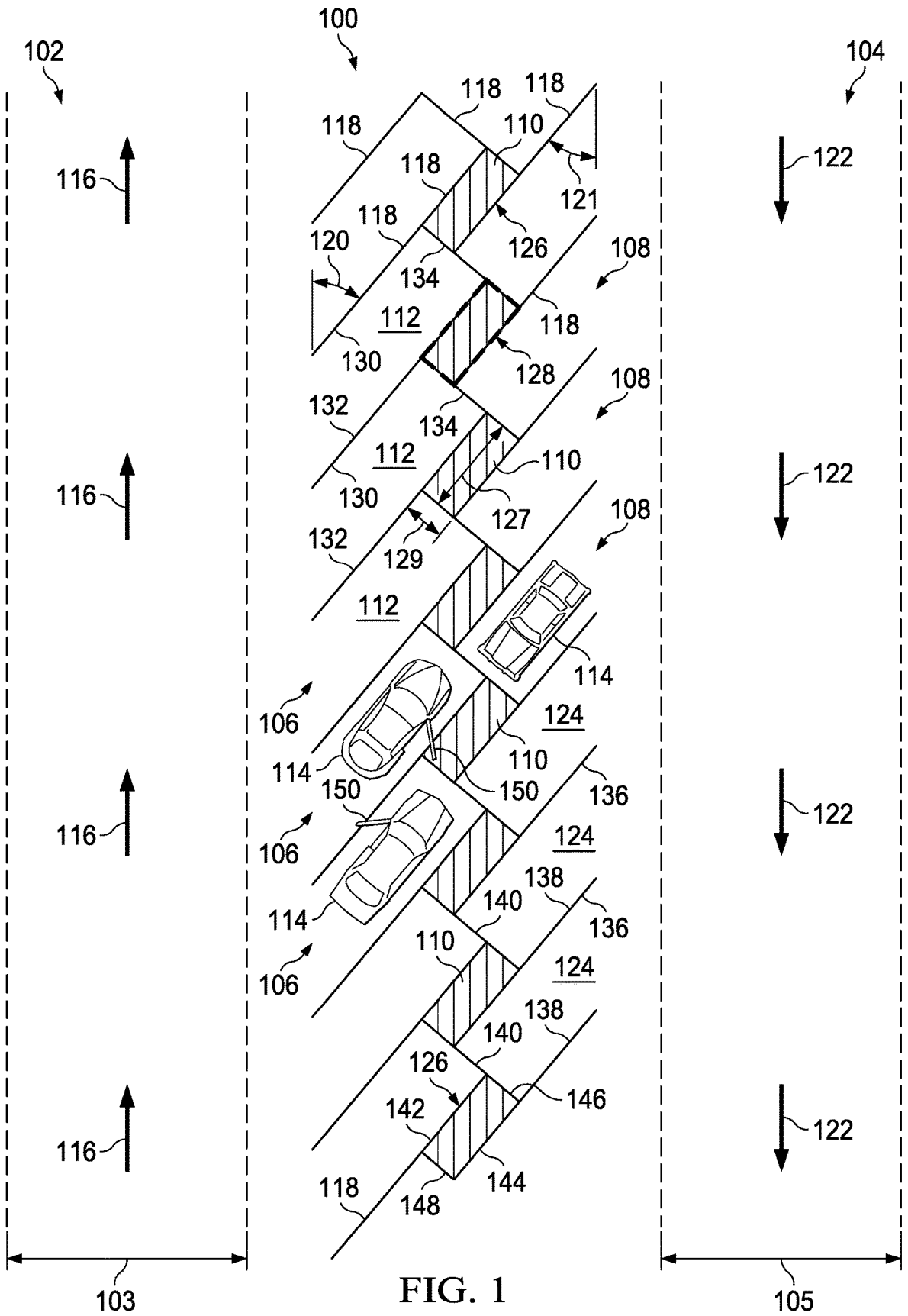
FIG. 1 is a top, plan view of a parking lot system, according to an illustrative embodiment.

Referring now primarily to FIG. 1, a top, plan view of a parking lot system 100, according to an illustrative embodiment, is presented. The parking lot system 100 includes a first driveway 102, or aisle, and a second driveway 104, or aisle. The first driveway 102 and the second driveway 104 are one-way driveways that are arranged in opposing directions. The first driveway 102 includes a first plurality of angled parking spaces 106. The second driveway 104 includes a second plurality of angled parking spaces 108. The parking lot system 100 further includes a plurality of buffer zones 110. The plurality of buffer zones 110 help prevent interference between automobiles parked in adjacent parking spaces in any of the first or second plurality of angled parking spaces 106, 108, while maximizing the automobile capacity within the parking lot.

The first driveway 102 is a one-way driveway extending in a first direction indicated by arrows 116. The first driveway 102 includes the first plurality of parking spaces 106 at least on one side of the first driveway 102. The first plurality of parking spaces 106 are positioned at an angle 120 relative to the first direction 116. The angle 120, in some embodiments, is steeper (smaller angle) than an average parking lot today, which may allow a width, 103, of the first driveway 102 to be narrower. The first plurality of parking spaces 106 are delineated by marked lines 118. In some embodiments, the marked lines 118 may be formed with paint or a covering or curbs. In still other embodiments, the parking spaces 106 may be interpreted by the front of the car to the front line, or third side 134 alone; in other words, only the front lines could be used.

The parking spaces of the first plurality parking spaces 106 comprise a first rectangular space 112, or first rectangle, which is at least partially delineated by the marked lines 118. While referenced as a rectangle, one or more of the sides, e.g., an entrance, may be missing. This is also true of the other rectangles mentioned herein.

The first rectangular space 112 is shown with an automobile 114 for which it is sized. The first rectangular space 112, includes a first side 130, a second side 132 opposing the first side 130 and a third side 134 orthogonal to the other two sides. The first side 130 and the second side 132 of the first rectangular space 112 are substantially parallel. Each of the parking spaces of the first plurality of parking spaces 106 are staggered relative to an adjacent parking space of the first plurality parking spaces 106. Staggering the first plurality of parking spaces 106 relative to each other may allow automobiles parked in adjacent spaces, within the first plurality of parking spaces 106, to be able to open doors 150 at the same time without interference between the automobile doors. In some aspects, staggering the first plurality of parking spaces 106 relative to an adjacent parking space allows front driver and passenger doors to open into an area either in front of or behind adjacent automobiles. In yet some aspects, staggering the first plurality of parking spaces 106 relative to adjacent parking space may allow for the parking spaces to be narrower.

The second driveway 104 is analogous to the first driveway 102. The second driveway 104 is a one-way driveway extending in a second direction indicated by arrows 122. The second driveway 104 includes the second plurality of parking spaces 108 on one side of the second driveway 104. The second plurality of parking spaces 108 are positioned at an angle 121 relative to the second direction 122. The angle 121 of the second plurality of parking spaces 108 relative to the second direction 122 is typically equal to the angle 120 of the first plurality parking spaces 106 relative to the first direction 120. The angle 121, similar to angle 120, may be steeper than an average parking lot today to allow a width, 105, of the second driveway 104 to be narrower. The second plurality of parking spaces 108 are delineated by the marked lines 118, which, in some embodiments, may be formed with paint or a covering or curbs. In still other embodiments, the parking spaces 108 may be interpreted by the front of the car to the front line, or third side 140 alone; in other words, only the front lines could be used. The second driveway 104 is adjacent to the first driveway 102 with a parking area (e.g., spaces 106, 108) between them.

The parking spaces for the second plurality of parking spaces 108 comprise a second rectangular space 124, which is at least partially delineated by the marked lines 118. The second rectangular space 124 is sized to accommodate the automobile 114. The second rectangular space 124 includes a first side 136, a second side 138 opposed to the first side 136 and a third side 140 orthogonal to the other two sides 136, 138. The first side 136 and the second side 138 of the second rectangular space 124 are substantially parallel. The parking spaces of the second plurality parking spaces 108 are staggered relative to an adjacent parking space of the second plurality spaces 108. Similar to the first plurality of parking spaces 106, staggering the second plurality of parking spaces 108 relative to each other may allow automobiles parked in adjacent spaces, within the second plurality of parking spaces 108, to be able to open doors at the same time without interference between the automobile door and an adjacent car. In some aspects, staggering the second plurality of parking spaces 108 relative to an adjacent parking space allows front driver and passenger doors to open into to an area either in front of or behind adjacent automobiles. In yet some aspects, staggering the second plurality of parking spaces 108 relative to adjacent parking space allows for the parking spaces to be narrower.

As shown in FIG. 1, the first plurality of parking spaces 106 at least partially abut the second plurality of parking spaces 108. Portions of the first plurality of parking spaces 106 are collinear with portions of the second plurality of parking spaces 108. In some aspects, the third side 134 of the first rectangular space 112 at least partially abuts the third side 140 of the second rectangular space 124. In yet some aspects, the third side 134 of the first rectangular space 112 is collinear with the third side 140 of the second rectangular space 124; in some embodiments, it is the same line.

Referring still primarily to FIG. 1, the parking lot system 100 further includes the plurality of buffer zones 110. Each of the plurality of buffer zones 110 has a perimeter 128. The perimeter 128 may be defined by the first and second plurality of parking spaces 106, 108 or a portion thereof. In some aspects, the plurality of buffer zones 110 is also delineated by a portion of the marked lines 118. Each of the plurality of buffer zones 110 comprises a third rectangular space 126. The third rectangular space 126 is adjacent to the first rectangular space 112 and the second rectangular space 124. The third rectangular space 126 is configured to provide an area for automobile doors to open without interference from an adjacent car. In some aspects, a door from an automobile in the first rectangular space 112 and a door of an automobile in the second rectangular space 124, which is adjacent thereto, may open concurrently without interference.

The third rectangular space 126 includes a first side 142, a second side 144, a third side 146 and a fourth side 148. The first side 142 and the second side 144 of the third rectangular space 126 are substantially parallel. The third side 146 and the fourth side 148 of the third rectangular space 126 are substantially parallel. Collectively, the first side 142, the second side 144, the third side 146, and the fourth side 148 of the third rectangular space 126 form the perimeter 128 of each of the plurality of buffer zones 110. The third rectangular space 126 has a length 127 that extends between the third side 146 and the fourth side 148. The third rectangular space 126 also has a width 129 that extends between the first side 142 and the second side 144.

In an embodiment, the first side 142 of the third rectangular space 126 at least partially abuts the second side 132 of one of the first rectangular spaces 112. Typically, the fourth side 148 of the third rectangular space 126 at least partially abuts the third side 134 of another of the first rectangular spaces 112. The third side 146 of the third rectangular space 126 at least partially abuts the third side 140 of one of the second rectangular spaces 124. The second side 144 of the third rectangular space 126 at least partially abuts the first side 136 of one of the second rectangular spaces 124.

In an embodiment, the first side 142 of the third rectangular space 126 is collinear, at least partially adjacent with the second side 132 of one of the first rectangular spaces 112 and the first side 130 of another of the first rectangular spaces 112; in one embodiment, the collinear adjacent portion comprises between 20% and 60% of the length of sides 130, 132, and all of side 142. In most instances, the fourth side 148 of the third rectangular space 126 is, at least partially adjacent and collinear with the third side 134 of the another of the first rectangular spaces 112; in one embodiment, the adjacent collinear portion is between 10% and 60% of side 134. The second side 144 of the third rectangular space 126 is, at least partially adjacent and collinear with the second side 138 of one of the second rectangular spaces 124 and the first side 136 of another of the second rectangular spaces 124; in one embodiment, the adjacent collinear portion is between 20% and 60% of sides 136, 138. The third side 146 of the third rectangular space 126 is, at least partially adjacent and collinear with the third side 140 of the one of the second rectangular spaces 124; in one embodiment the adjacent collinear portion is between 10% and 60% of side 140.

In an embodiment, the first side 142 of the third rectangular space 126 at least partially abuts the second side 132 of one of the first rectangular spaces 112 and is at least partially also collinear with the second side 132 of one of a first rectangular space 112 and the first side 130 of another of the first rectangular spaces 112. The second side 144 of the third rectangular space 126 at least partially abuts the first side 136 of one of the second rectangular spaces 124 and is also collinear with the second side 138 of one of the second rectangular spaces 124. The third side 146 of the third rectangular space 126 at least partially abuts and is at least partially collinear with the third side 140 of one of the second rectangular spaces 124. The fourth side 148 of the third rectangular space 126 at least partially abuts and is at least partially collinear with the third side 134 of the one of the first rectangular spaces 112.

In some aspects, the first plurality of parking spaces 106 is staggered relative to each other, in the direction a car parks, a distance equal to a length 127 of the buffer zone 110. The length of 127 the buffer zone 110 extends between the third side 146 and the fourth side 148 of the third rectangular space 126. Likewise, the second plurality of parking spaces 108 are staggered relative to each other a distance equal to the length, 127, of the buffer zone 110. In some aspects, some of the first plurality of parking spaces 106 are offset from some of the second plurality of parking spaces 108 a distance equal to the width 129, of the buffer zone 110. The width 129 extends between the first and second side 142, 144 of the buffer zone 110.

Figure 2:
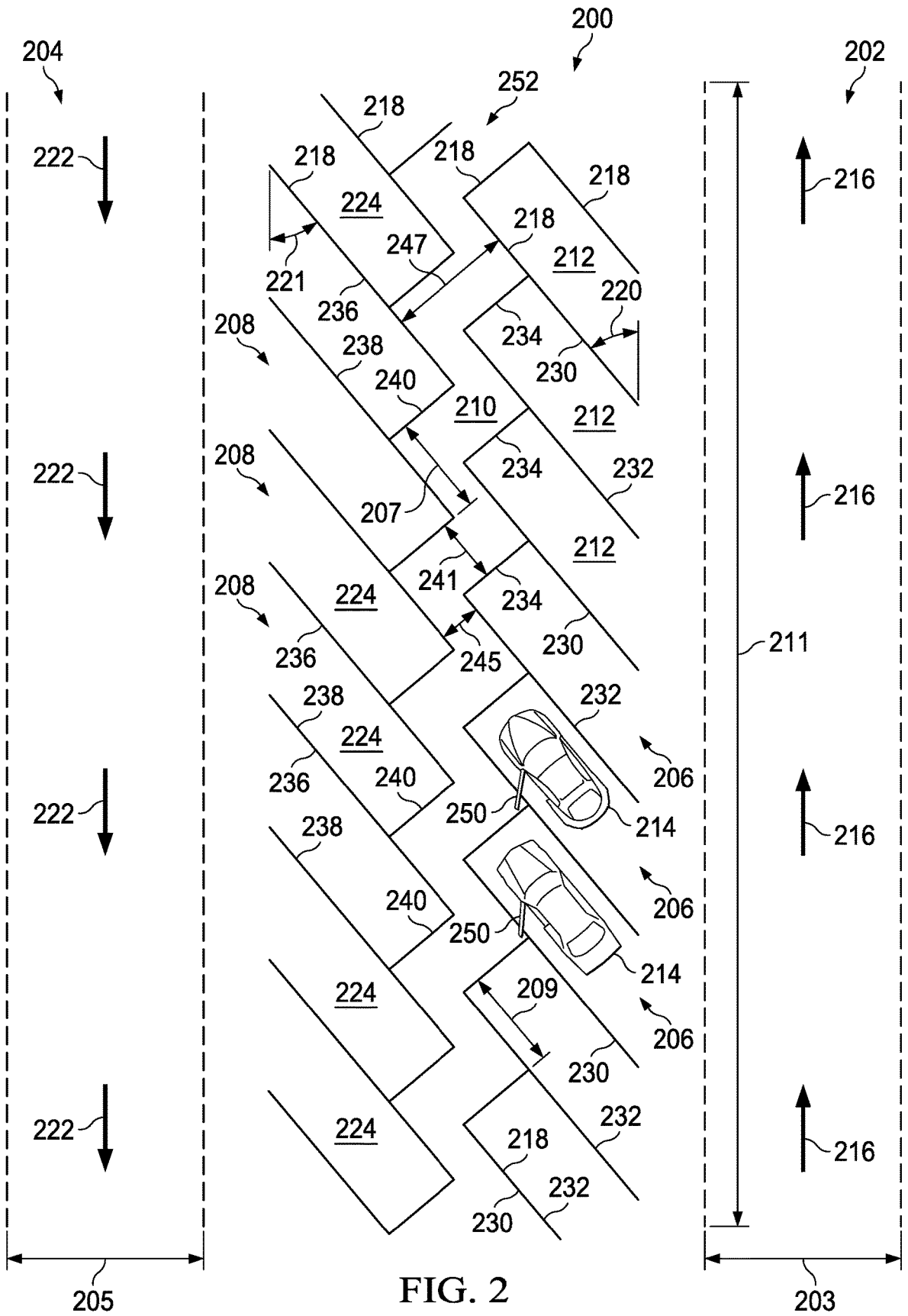
FIG. 2 is a top, plan view of another parking lot system, according to an illustrative embodiment.

Referring now primarily to FIG. 2, a top, plan view of a parking lot system 200, according to an illustrative embodiment, is presented. The parking lot system 200 includes a first driveway 202, or aisle, and a second driveway 204, or aisle. The first driveway 202 and the second driveway 204 are one-way driveways that are arranged in opposing directions. The first driveway 202 includes a first plurality of angled parking spaces 206, or parking stalls. The second driveway 204 includes a second plurality of angled parking spaces 208, or parking stalls. The parking lot system 200 further includes a buffer zone 210. The buffer zone 210 provides a walkway for pedestrians between the first and second plurality of angled parking spaces 206, 208 and creates room between parking spaces to help prevent interference between automobiles parked in adjacent parking spaces.

The first driveway 202 is a one-way driveway extending in a first direction indicated by arrows 216. The first driveway 202 includes the first plurality of parking spaces 206 on one side of the first driveway 202. The first plurality of parking spaces 206 are positioned at an angle 220 relative to the first direction 216. The angle 220, in some embodiments, is steeper (smaller angle) that an average parking lot today, which may allow a width, 203, of the first driveway 202 to be narrower. The first plurality of parking spaces 206 are delineated by marked lines 218. In some embodiments, the marked lines 218 may be formed with paint or a covering or curbs.

The parking spaces of the first plurality of parking spaces 206 comprise a first rectangular space 212, which is at least partially delineated by the marked lines 218. The first rectangular space 212 is sized to accommodate an automobile 214. The first rectangular space 212 includes a first side 230, a second side 232 and a third side 234. The first side 230 and the second side 232 of the first rectangular space 212 are substantially parallel. The parking spaces of the first plurality of parking spaces 206 are staggered with respect to the direction a car pulls in and relative to an adjacent parking space of the first plurality of parking spaces 206 by a length 209. Staggering the first plurality of parking spaces 206 relative to each other allows automobiles parked in adjacent spaces, within the first plurality of parking spaces 206, to be able to open doors 250 at the same time without interference. In some aspects, staggering the first plurality of parking spaces 206 relative to an adjacent parking space allows front driver and passenger doors to open into to an area either in front of or behind adjacent automobiles. In yet some aspects, staggering the first plurality of parking spaces 206 relative to adjacent parking space allows for the parking spaces to be narrower.

The second driveway 204 is analogous to the first driveway 202. The second driveway 204 is a one-way driveway extending in a second direction indicated by arrows 222. The second driveway 204 includes the second plurality of parking spaces 208 on one side of the second driveway 204. The second plurality of parking spaces 208 are positioned at an angle 221 relative to the second direction 222. The angle 221 of the second plurality of parking spaces 208 relative to the second direction 222 may be equal to the angle 220 of the first plurality parking spaces 206 relative to the first direction 220. The angle 221, similar to angle 220, maybe steeper than an average parking lot today to allow a width, 205, of the second driveway 204 to be narrower. The second plurality of parking spaces 208 are delineated by the marked lines 218, which, in some embodiments, may be formed with paint or a covering or curbs.

The parking spaces for the second plurality of parking spaces 208 comprise a second rectangular space 224, which is at least partially delineated by the marked lines 218. The second rectangular space 224 is sized to accommodate the automobile e.g., automobile 214. The second rectangular space 224 includes a first side 236, a second side 238 and a third side 240. The first side 236 and the second side 238 of the second rectangular space 224 are substantially parallel. The parking spaces of the second plurality parking spaces 208 are staggered relative to the direction an automobile parks and relative to an adjacent parking space of the second plurality of spaces 208 by a length 207, which is equal to the length 209. Similar to the first plurality of parking spaces 206, staggering the second plurality of parking spaces 208 relative to each other allows automobiles parked in adjacent spaces, within the second plurality of parking spaces 208, to be able to open doors at the same time without interference between the automobile doors. In some aspects, staggering the second plurality of parking spaces 208 relative to an adjacent parking space allows front driver and passenger doors to open into an area either in front of or behind adjacent automobiles. In yet some aspects, staggering the second plurality of parking spaces 208 relative to adjacent parking space allows for the parking spaces to be narrower.

Referring still primarily to FIG. 2, the parking lot system 200 further includes the buffer zone 210. The buffer zone 210 is sized to provide a walkway for pedestrians between the first and second plurality of angled parking spaces 206, 208 and to create room between adjacent parking spaces to help prevent interference between automobiles parked therein. Automobiles parked in adjacent parking spaces may include automobiles parked adjacent to each other in the first plurality of parking spaces 206, automobiles parked adjacent to each other in the second plurality of parking spaces 208, and automobiles parked adjacent to each other in both the first and second plurality of parking spaces 206, 208.

The buffer zone 210 is positioned between the first and second plurality of angled parking spaces 206, 208 and, in some embodiments, extends a length 211 that is equal to the overall length of the first and second plurality of angled parking spaces 206, 208. The buffer zone 210 forms a gap 252 that separates the first and second plurality of angled parking spaces 206, 208. In some aspects, the buffer zone 210 has a zig-zag pattern that extends the length 211 of the buffer zone 210.

The buffer zone 210 separates the third side 234 of the first rectangular space 212 and the third side 240 of the second rectangular space 224 by a distance 241. The buffer zone 210 also separates the second side 232 of the first rectangular space 212 and the first side 236 of the second rectangular space 224 a distance, 245 or 247. In some embodiments, the distance, 241, between the third side 234 of the first rectangular space 212 and the third side 240 of the second space 224 is greater than the distance, 245 or 247, between the second side 232 of the first rectangular space 212 and the first side 236 the second rectangular space 224. In some embodiments, the distance 241 is between 15 inches and 70 inches. In some embodiments, the width of the gap 252 at its smallest is between 15 and 70 inches.

Figure 3A:
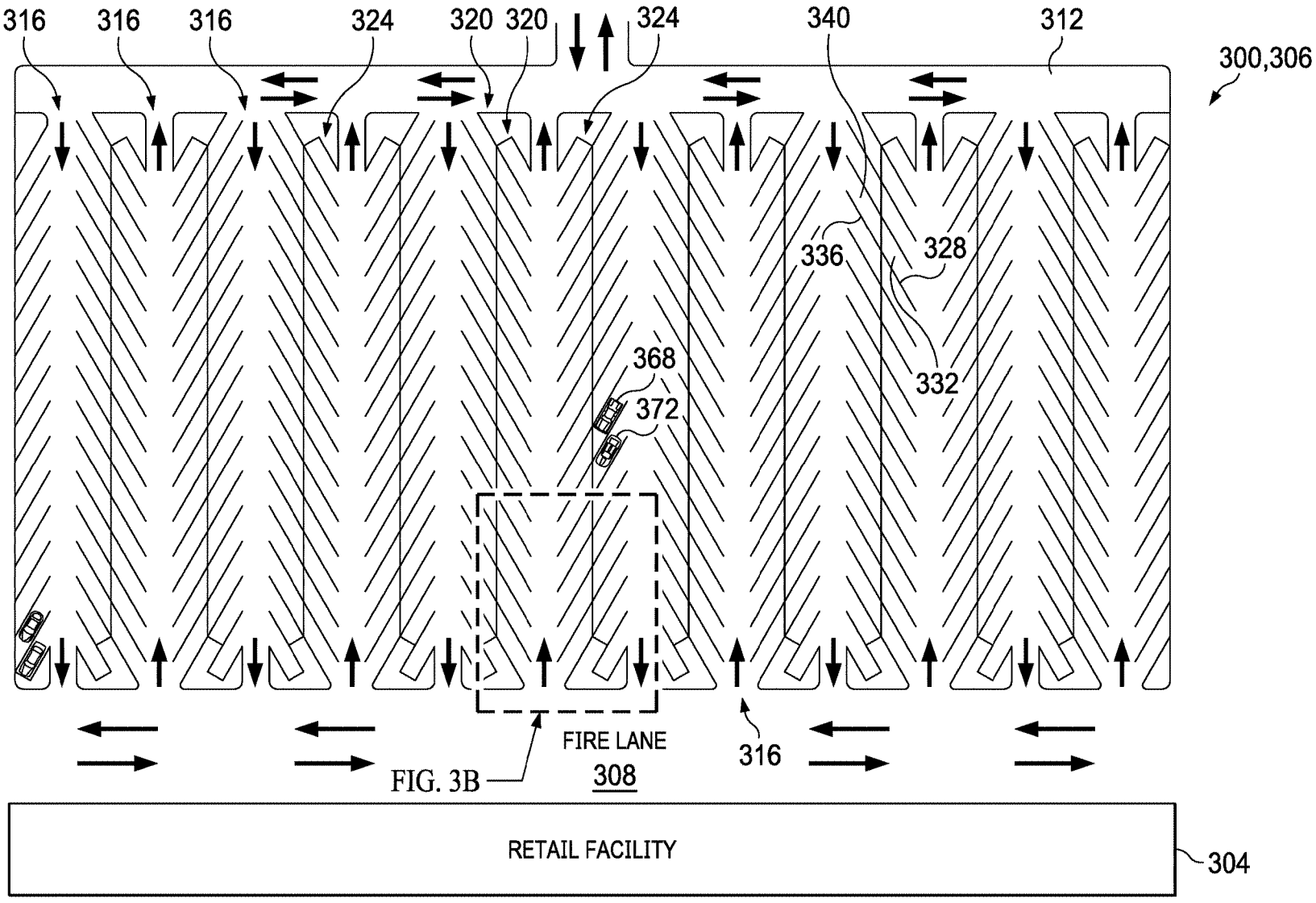
FIG. 3A is a top, plan view of a parking lot system, according to an illustrative embodiment.
Figure 3B:
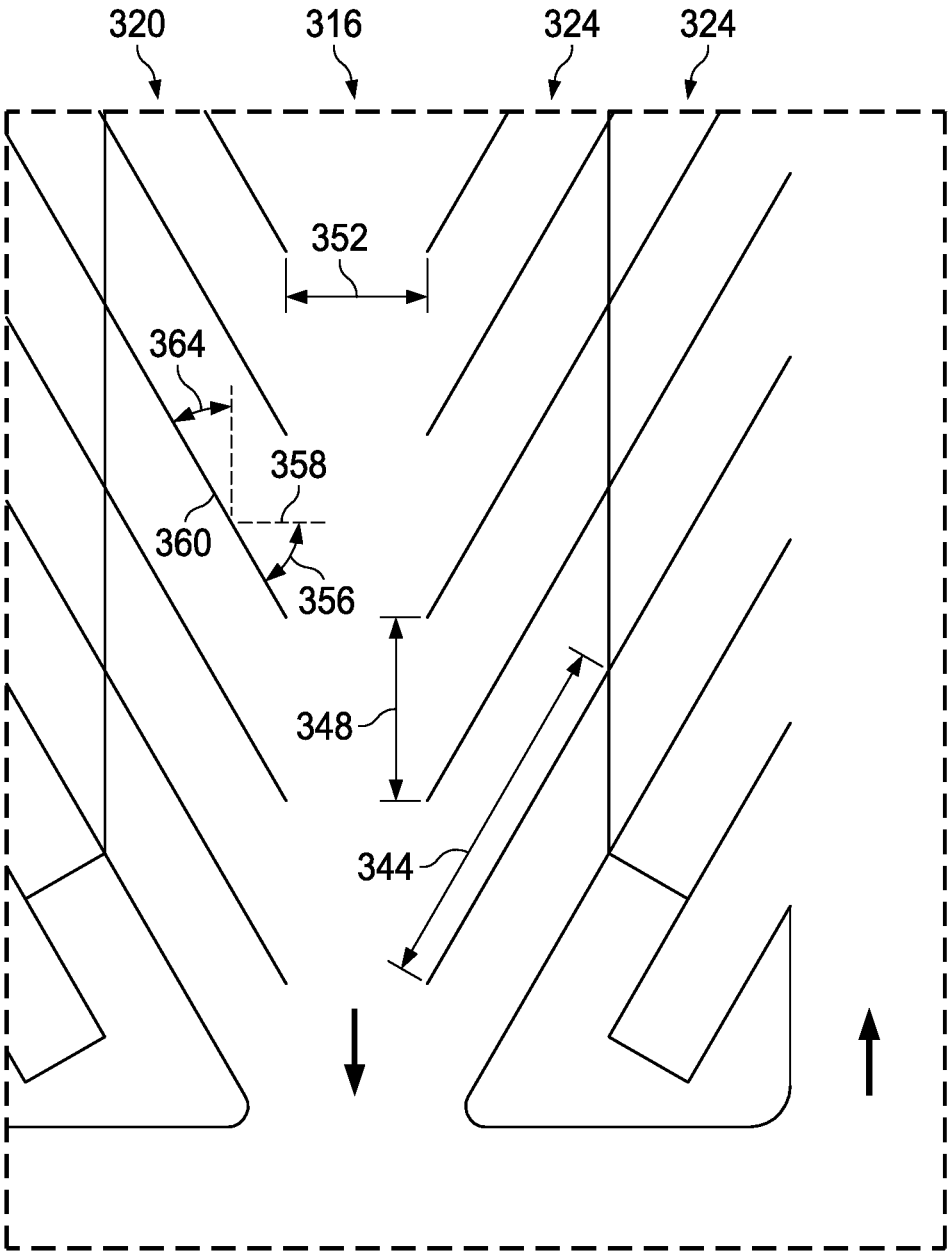
FIG. 3B is a detail of a portion of the parking lot system of FIG. 3A.

Referring now primarily to FIG. 3A-3B, another illustrative embodiment of a parking lot system 300 is presented such as be used with a retail facility 304. The parking lot 306 for the retail facility 304 may include a fire lane 308 on one end and two-way aisle 312 that access plurality of one-way driveways 316.

Each of the one-way driveways 316 has a first plurality of parking stalls or spaces 320 on one side and a second plurality of parking stalls or spaces 324 on the opposite side. Each plurality of parking spaces 320, 324 (except very end ones) is adjacent with one on the adjacent aisle and has colinear markings or stripes, e.g., marking or stripe 328 forms a portion of a particular parking space 332 and extends to form marking or stripe 336 of particular parking space 340.

As seen best in FIG. 3B, useable length 344 of a space of the plurality of spaces 324 (or 320) is in the range of 18-22 feet and in one embodiment is 20 feet. A width 348 of the same space may be in the range of 8 to 10 feet and in one example is 9 feet. A distance 352 between parking spaces on opposite sides of the driveway 316 is in the range of 12.5 feet and 14.5 feet and in one embodiment was 13 feet 11 inches. An angle of the parking spaces 320, 324 may be defined as an angle 356, which is an angle between a line 358 orthogonal to the direction of driveway 316 and a longitudinal line 360 of the parking space or by an angle 364 between the longitudinal line 360 of the parking space and the direction of the driveway 316. In one embodiment, angle 364 is in the range of 25-40 and in one embodiment is 30 degrees. Alternatively stated, in one embodiment, angle 356 is in the range of 50-65 and in embodiment is 60 degrees.

As suggested by the automobiles 368 and 372, the parking lot system 300 with the angles and length of the parking spaces provides parking where the car doors of adjacent cars will not hit the adjacent car. While the number of parking spaces may be reduced some, the contentment of the drivers is presumably enhanced.

With reference to FIGS. 3A and 3B, the equivalent lot size for a traditional parking lot (excluding handicapped parking) would total approximately 572 spaces when the parking space or stall is 9 feet by 19 feet, single driver driveways that are 20 feet wide and two-way driveways that are 24 feet wide, with three two-way aisles, and stalls at a 30-degree angle. The 30-degree angle is with respect to a reference line orthogonal to the direction of the driveway (see 356 in FIG. 3B). In the parking lot system 300 shown, the number of spaces drops to approximately 371 (excluding handicap parking) with park stalls 9 feet×20 feet; single drive driveways at 13 feet 11 inches and no two-way drive aisles. The angles on the parking stalls or slots are 60 degrees for angle 356.

Figure 4A:
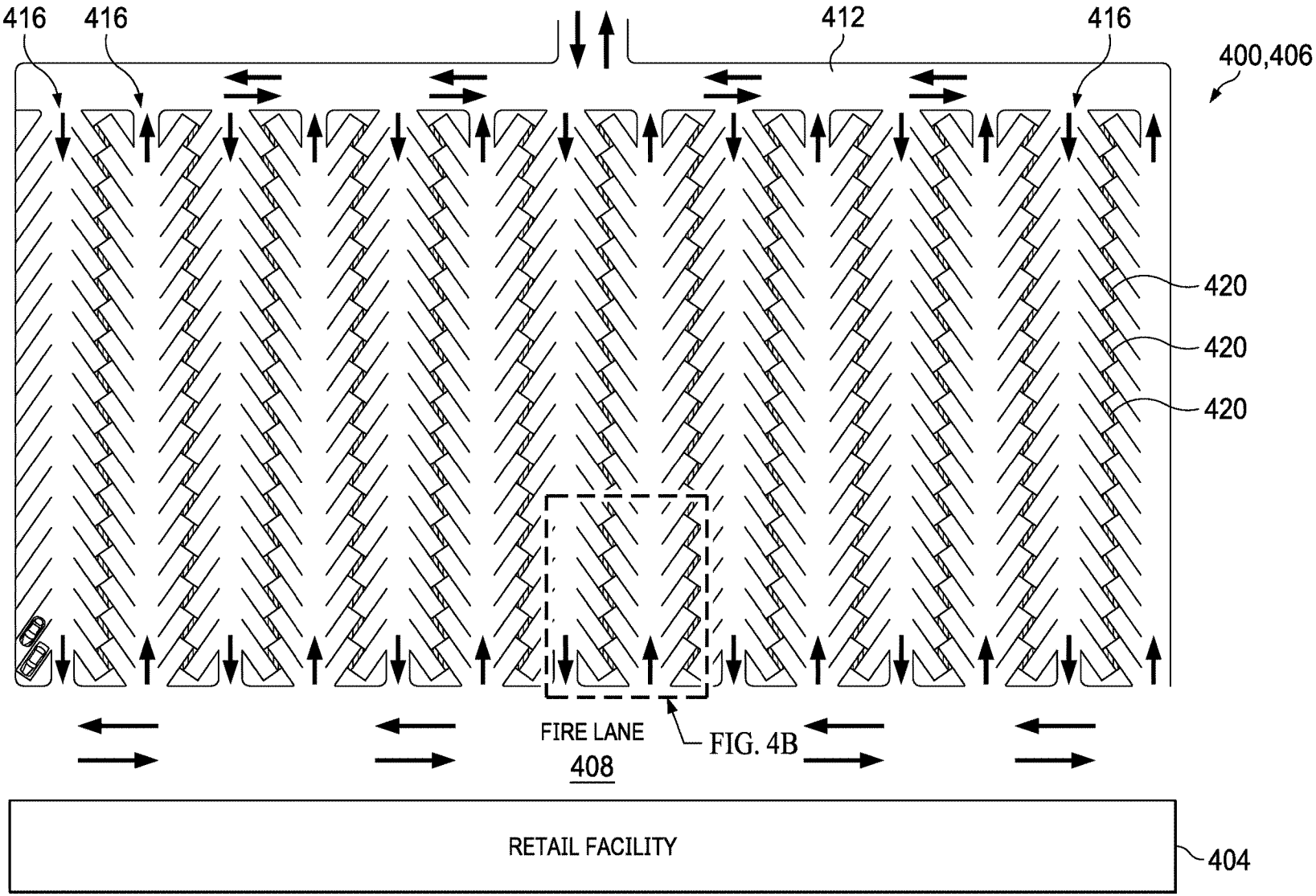
FIG. 4A is a top, plan view of a parking lot system, according to an illustrative embodiment.
Figure 4B:
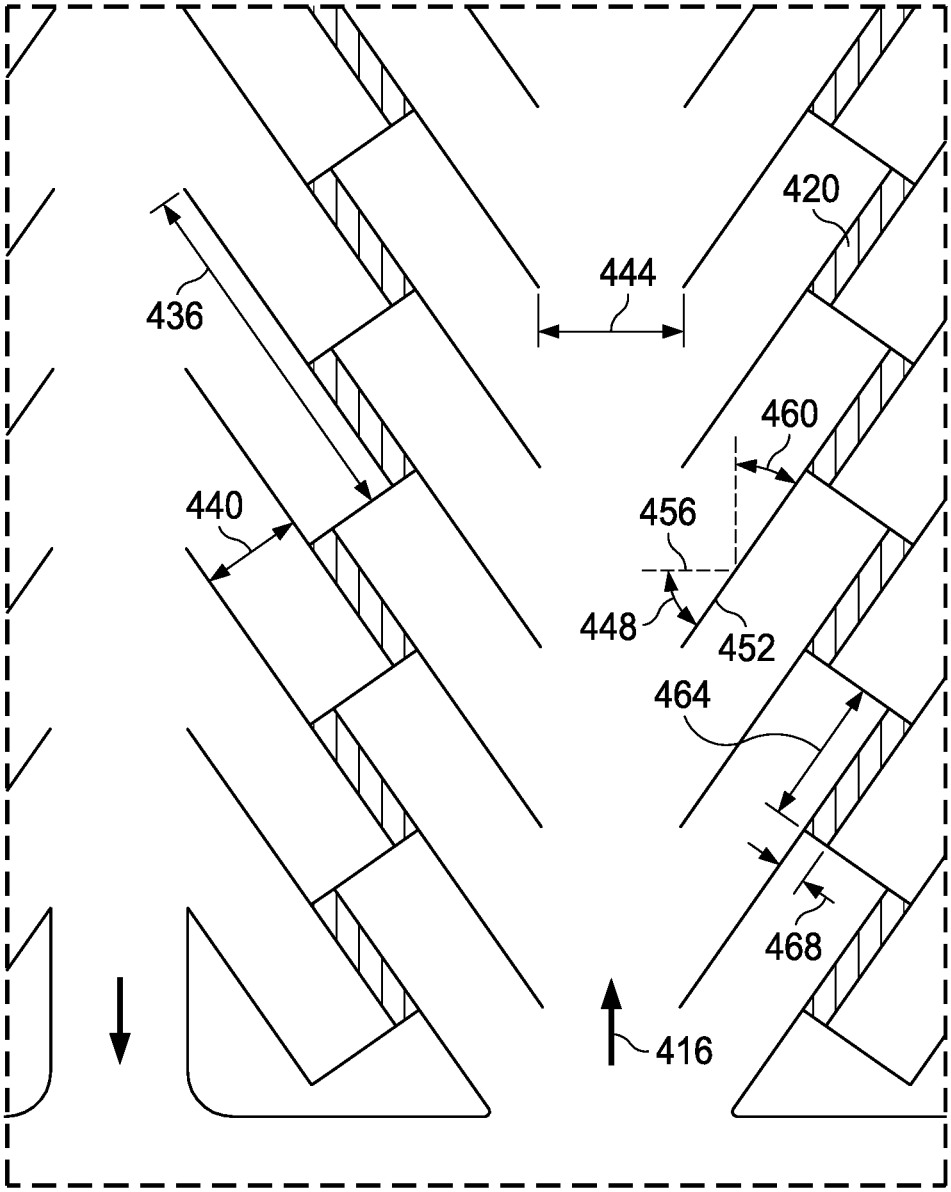
FIG. 4B is a detail of a portion of the parking lot system of FIG. 4A.

Referring now primarily to FIG. 4A-4B, another illustrative embodiment of a parking lot system 400 according to the present disclosure is presented such as be used with a retail facility 404. The parking lot 406 for the retail facility 404 may include a fire lane 408 on one end and two-way aisle 412 that access plurality of one-way driveways 416. The system 400 includes a plurality of buffer zones 420. This is a configuration for the same available space for the parking lot shown in FIG. 3A and is analogous in many respects to the system 100 of FIG. 1.

As seen more clearly in FIG. 4B, each driveway or aisle 416 has a first plurality of parking spaces 428 on one side and second plurality of parking spaces 432 on the other side. Each parking space has a longitudinal length 436 in the range of 15-25 feet and in one embodiment is 19 feet and has a lateral width 440 in the range of 6 to 12 feet and in one embodiment is 9 feet. A distance 444 across the driveway 416 is in the range of 8-16 feet and in one embodiment is 12 feet. The spaces are angled as shown by angle 448 between a longitudinal line 452 of a parking space and a line 456 perpendicular (or orthogonal) to the direction of the driveway 416 or alternatively by angle 460 between the longitudinal line 452 and the direction of the driveway 416. In one embodiment, angle 448 is in the range of 30 to 80 degrees and in one embodiment is 55 degrees. In other embodiment, angle 448 is 50 degrees. In another embodiment, angle 448 is 60 degrees. Angle 460 is in the range of 10-60 degrees and in one embodiment is 35 degrees. In one embodiment, each buffer zone 420 has a longitudinal length 464 in the range of 10-16 feet and in one embodiment is 13 feet and has a lateral width 468 is in the range of 1 to 4 feet and in one embodiment is 2 feet six inches. In another embodiment, lateral width 468 is two feet. In another embodiment, lateral width 468 is three feet.

In a specific illustrative embodiment with dimensions that are as follows: longitudinal length 436 is 19 feet; lateral width 440 is 9 feet; distance across the driveway 444 is 12 feet, and the angle orthogonal to the driveway and with respect to a side of the space is 55 degrees, and excluding handicap parking, 486 parking stalls are available, each 9'×19' with the single drive aisles at 12' wide and the two-way aisles at 24' wide. Only the ends are two-way. Again, the parking stalls are at 55 degrees in this embodiment.

According to an illustrative embodiment and with reference to FIG. 1 again, a parking lot system 100 includes a first one-way driveway 102 extending in a first direction 116 and a second one-way driveway 104 extending in a second direction 122 that is opposite to the first direction 116. The second one-way driveway 104 is adjacent to the first one-way driveway 102 separated by a parking area (e.g., center portion of FIG. 1).

The first one-way driveway includes a first plurality of parking spaces 106 on one side. Each parking space of the first plurality of parking spaces 106 includes a first rectangular space 112 formed by lines, except at an entrance, and is sized to accommodate at least an average automobile. In addition, a second rectangular space 126 formed by lines and adjacent to the first rectangular space 112. The second rectangular space 126 forms a buffer zone 110. When an automobile is parked in the first rectangular space 112, a door of the automobile opens into the buffer zone 110.

In one illustrative embodiment, the first rectangular space 112 has a longitudinal length L1, e.g., 15-30 feet, and the second rectangular space 126 has a longitudinal length L2 running parallel and adjacent to a side of the first rectangular space 112, and L2 is between 15 and 60% of L1 and is sized to accommodate a door of an automobile. In one example, L1 is 20 feet and L2 is six feet long. In another example, L1 is 18 feet and L2 is 5.5 feet. In still another example, L1 is between 17 and 21 feet and L2 is between 3.4 and 12.6 feet. Those skilled in the art will appreciate that different dimensions may be used for different applications or vehicle sizes.

The second one-way driveway 104 includes a second plurality of parking spaces 108 on one side closest to the first one-way driveway 102. Each parking space of the second plurality of parking spaces 108 includes a third rectangular space 124 formed by lines, except at perhaps an entrance and is sized to accommodate an automobile. The second rectangular space 126 associated with an adjacent space of the first plurality of parking spaces 106 is also adjacent to a portion of the space of the second plurality of spaces 108 and is positioned to receive a car door when an automobile is parked within the space of the second plurality of parking spaces 108.

The first plurality of parking spaces 106 and the second plurality of parking spaces 108 at least partially abut one another directly. The buffer zone 110 is enclosed on each side by the first plurality of parking spaces 106 and the second plurality of parking spaces 108.

In the detailed description herein of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized, and that logical structural, mechanical, electrical, and chemical changes may be made without departing from the spirit or scope of the invention. To avoid detail not necessary to enable those skilled in the art to practice the invention, the description may omit certain information known to those skilled in the art. The detailed description is, therefore, not to be taken in a limiting sense, and the scope of the present invention is defined only by the claims. Unless otherwise indicated, as used throughout this document, "or" does not require mutual exclusivity.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

The invention claimed is:

1. A parking lot system comprising:

a first one-way driveway extending in a first direction;

a second one-way driveway extending in a second direction that is opposite to the first direction and wherein the second one-way driveway is adjacent to the first one-way driveway separated by a parking area;

the first one-way driveway comprising a first plurality of parking spaces on one side, wherein each parking space of the first plurality of parking spaces comprises a first rectangular space formed by lines, except an entrance, and sized to accommodate an automobile and having a second rectangular space formed by lines and adjacent to the first rectangular space, wherein the second rectangular space comprises a buffer zone and wherein when an automobile is parked in the first rectangular space a door of the automobile opens into the buffer zone;

wherein the first rectangular space has a longitudinal length L1, the second rectangular space has a longitudinal length L2 running parallel and adjacent to a side of the first rectangular space, and L2 is at least 20% of L1 to accommodate a door of an automobile;

the second one-way driveway comprising a second plurality of parking spaces on one side closest to the first one-way driveway, wherein each parking space of the second plurality of parking spaces comprises a third rectangular space formed by lines, except an entrance, and sized to accommodate an automobile and wherein the second rectangular space associated with an adjacent space of the first plurality of parking spaces is also adjacent to a portion of the space of the second plurality of spaces and is positioned to receive a car door when an automobile is parked within the space of the second plurality of parking spaces;

wherein the first plurality of parking spaces and the second plurality of parking spaces at least partially abut one another directly; and wherein the buffer zone is enclosed on each side by the first plurality of parking spaces and the second plurality of parking spaces.

2. The system of claim 1, wherein L2 is at least 5 feet.

3. The system of claim 1, wherein a side of the first rectangular space at least partially abuts a side of the second rectangular space.

4. The system of claim 1, wherein:

the second rectangular space is defined by a first side, a second side, a third side and a fourth side, the first side parallel with the second side, and the third side parallel with the fourth side;

the first side of the second rectangular space is collinear with one side of the first rectangular space; and the second side of the second rectangular space is collinear with one side of the third rectangular space.

5. The system of claim 1, wherein the first plurality of parking spaces is angled acutely relative to the first direction of the first one-way driveway, and wherein the second plurality of parking spaces is acutely angled relative to the second direction of the second one-way driveway.

6. The system of claim 1, wherein each parking space of the first plurality of parking spaces is staggered relative to each other.

7. The system of claim 6 wherein each parking space of the first plurality of parking spaces is staggered a distance equal to a longitudinal length of the buffer zone.

8. The system of claim 1, wherein each parking space of the second plurality of parking spaces is staggered relative to each other.

9. The system of claim 8, wherein each parking space of the second plurality of parking spaces is staggered a distance equal to a longitudinal length of the buffer zone.

10. The system of claim 1, wherein each parking space of the first plurality of parking spaces is angled with a first side of the first rectangle forming an angle in the range of 30 to 40 degrees relative to the direction of the first driveway.

11. The system of claim 1, wherein the buffer zone is enclosed on each side by the first plurality of parking spaces and the second plurality of parking spaces;

the second rectangular space is defined by a first side, a second side, a third side and a fourth side, the first side parallel with the second side, and the third side parallel with the fourth side;

the first side of the second rectangular space is collinear with one side of the first rectangle;

the second side of the second rectangular space is collinear with one side of the third rectangle;

an angle is formed between a longitudinal side of each parking space of the first plurality of parking spaces and a reference line that is orthogonal to the first direction of the first driveway, wherein for each parking space of the first plurality of parking spaces the angle is between 40 to 60 degrees; and wherein the buffer zone has a longitudinal length, L2, in the range of 6 to 20 feet and has a lateral width in the range of 0.5 to 8 feet.

12. A parking lot system comprising:

a first driveway extending in a first one-way direction of travel;

wherein the first driveway comprises:

a first plurality of angled parking spaces positioned on one side of the first driveway, wherein each parking space of the first plurality of angled parking spaces forms a first rectangular space formed by lines on one or more sides and sized to accommodate an automobile, wherein the first rectangular space is at least partially defined by a first side, a second side and a third side, and wherein the first and second sides are parallel to one another;

a second driveway extending in a second one-way direction of travel that is opposite to the first one-way direction, wherein the second driveway comprises:

a second plurality of angled parking spaces positioned on a side of the second driveway closest to the first driveway, wherein each parking space of the second plurality of angled parking spaces forms a second rectangular space formed by lines on one or more sides and sized to accommodate an automobile, wherein the second rectangular space is at least partially defined by a first side, a second side and a third side, and wherein the first and second sides of the second rectangular space are parallel with one another;

a plurality of buffer zones, wherein each of the plurality of buffer zones has a perimeter;

wherein each perimeter of the plurality of buffer zones comprises:

a portion of the first and second plurality of angled parking spaces such that the each of the plurality of buffer zones is surrounded on all sides by the first and second plurality of angled parking spaces, and wherein a car in one of the first plurality of angled parking spaces is positioned relative to one of the plurality of buffer zones such that its passenger door opens into the buffer zone and a car in an adjacent parking space of the second plurality of angled parking spaces also has its passenger door open into the buffer zone; and wherein the first plurality of parking spaces and the second plurality of parking spaces at least partially abut one another directly.

13. The parking lot system of claim 12, wherein the first plurality of angled parking spaces and the second plurality of angled parking spaces are positioned between the first driveway and the second driveway.

14. The parking lot system of claim 12, wherein the each of the plurality of buffer zones forms a third rectangular space, and wherein adjacent parking spaces in the first plurality of angled parking spaces and the second plurality of angled parking spaces are staggered a longitudinal length of the third rectangular space.

15. The parking lot system of claim 12, wherein the third side of the first rectangular space is collinear and partially overlaps at least partially with the third side of the second rectangular space.

* * * * *